US005183191A

United States Patent [19]

Garrison et al.

[11] Patent Number: 5,183,191

[45] Date of Patent: Feb. 2, 1993

[54] HANGERS WITH LONG LASTING NON-SLIP SURFACES

[75] Inventors: Judd F. Garrison, Grand Rapids; Russell O. Blanchard, Zeeland, both of Mich.

[73] Assignee: Batts, Inc., Zeeland, Mich.

[21] Appl. No.: 832,060

[22] Filed: Feb. 6, 1992

[51] Int. Cl.[5] ..... A47G 25/48; A47G 25/14

[52] U.S. Cl. ..... 223/96; 223/91; 24/564

[58] Field of Search ..... 223/96, 95, 91, 90, 223/85, 88; 24/564

[56] References Cited

U.S. PATENT DOCUMENTS

| | | | |
|---|---|---|---|
| D. 271,649 | 12/1983 | Batts et al. | D6/253 |
| D. 298,387 | 11/1988 | Duester | D6/328 |
| D. 299,086 | 12/1988 | Wilson | D6/326 |
| D. 307,982 | 5/1990 | Duester | D6/328 |
| 695,924 | 3/1902 | Grotenhuis | 223/96 |
| 1,205,551 | 10/1916 | Leach | 223/95 |
| 2,212,978 | 8/1940 | Deknatel | 223/96 |
| 2,463,136 | 3/1949 | Baer, Sr. | 223/90 |
| 2,920,801 | 1/1960 | Batts | 223/96 |
| 3,102,668 | 9/1963 | Milligan | 223/95 |
| 3,767,092 | 10/1973 | Garrison et al. | 223/96 |
| 4,084,299 | 4/1978 | Noda | 24/250 |
| 4,231,500 | 11/1980 | Mainetti | 223/96 |
| 4,658,996 | 4/1987 | Warmath | 223/96 |
| 4,716,634 | 1/1988 | Fan | 24/545 |
| 4,722,120 | 2/1988 | Lu | 24/564 X |
| 4,746,039 | 5/1988 | Batts et al. | 223/96 |
| 4,759,480 | 7/1988 | Duester et al. | 223/96 |
| 4,826,056 | 5/1989 | Duester et al. | 223/96 |
| 5,020,705 | 6/1991 | Garrison | 223/96 |
| 5,082,153 | 1/1991 | Duester et al. | 223/96 |

*Primary Examiner*—Andrew M. Falik
*Assistant Examiner*—Bibhu Mohanty
*Attorney, Agent, or Firm*—James G. Staples

[57] ABSTRACT

A clamp-type garment hanger with pads of resilient friction material on the inner clamping surfaces of the garment clamp assemblies to provide non-slip surfaces for garments such as trousers, skirts and the like. The non-slip surfaces on the clamp assemblies prevent the garments from slipping through the clamp asssemblies and falling onto the floor. The application of resilient friction material to the inner clamping surfaces applies equally to all types of clamp-type garment hangers. The resilient friction material used on the clamping surfaces comprises a block copolymer having discreet block segments of styrene monomer units and rubber monomer units.

28 Claims, 3 Drawing Sheets

10
11
12
13
14
15
16
17
18
20
21
22
23
24
25
26
27
28
29
30
31
32
34
35
36
37
38
39
41
42
44
45
46
47
48
49
50
51
52
53
5
6

83a
82
83
89
85
87
88
90

110
113
112
86
84

97
98
94
92
93
91
95
96
101
99
100
102

HANGERS WITH LONG LASTING NON-SLIP SURFACES

This invention relates generally to clamp-type garment hangers with clamp assemblies that include non-slip surfaces for positively gripping garments. Specifically, this invention relates to clamp-type garment hangers wherein the garment gripping pads are made of resilient friction material for positively gripping the garments.

BACKGROUND OF THE INVENTION

A common problem associated with today's clamp-type garment hangers is that the garments slip through the clamp assemblies, or clamps, and fall to the floor with unacceptable frequency. This problem is particularly annoying to a consumer who places a relatively expensive and fragile garment, such as a pair of dress slacks or a skirt, on a clamp-type garment hanger. The slacks or skirt often slip through the clamp assemblies and fall to the floor thereby becoming wrinkled and requiring ironing or dry cleaning.

In order to avoid this situation, manufacturers of clamp-type garment hangers have designed clamp assemblies with rough or sharp edges to positively grip the garment. However, clamp assemblies with rough garment-engaging surfaces have the potential of damaging delicate materials such as silk or linen through extended use. One particular problem is associated with clamp assemblies that employ outwardly protruding nipple-like projections or cleats. The nipple-like projections leave indentations in the cuffs of slacks and the waist-bands of skirts. Removal of these indentations normally requires ironing or dry cleaning, or the consumer may have to wear the garment due to inadequate time to remove the indentations.

The above-mentioned shortcomings are not only annoying to the consumers but to the manufacturers of garments as well. First, a manufacturer cannot tolerate a clamp-type garment hanger that, with unacceptable frequency, allows the garments to slip through the clamp assemblies and fall to the floor. Manufacturers of garments often ship their expensive garments already hung on clamp-type garment hangers. The garments will wrinkle or become damaged if they fall off the hangers during transit. By the same token, retailers are very particular about product presentation and will not tolerate garment hangers that permit garments to fall onto the floor. Further, neither manufacturers nor retailers can tolerate clamp-type garment hangers that employ rough clamping surfaces or nippled clamping surfaces because such designs have the potential to damage fragile or expensive garments, or at least, mar the appearance thereby detracting from the sales appeal to the purchaser.

Hence, there is a need for a new clamp-type garment hanger that meets the aforenoted criteria. Specifically, the clamp assemblies must positively grip the garment without either marking or adhering to the garment fabric. Further, because the hanger must be capable of use as a shipping hanger by clothing manufacturers, the clamp assembly must be able to maintain its gripping ability under a wide range of temperatures and rough handling resulting from the shocks and bumps to which such hangers are exposed during shipment. It is highly desirable to produce a clamp assembly with a clamping surface that is both smooth to the touch and has the ability to positively grip the garments for an extended period of time. A clamping surface that is smooth to the touch is pleasing to the consumer and assures the consumer that the clamping surface will not damage the garment.

A clamp-type garment hanger that meets the aforenoted criteria must also be competitive from a cost-to-produce basis. Specifically, dissimilar components of the clamp-type garment hanger must easily bond to one another. Second, the improved clamping surface must be comprised of competitively priced, yet readily accessible materials.

This invention provides a solution to all of the above-mentioned problems and satisfies all of the above criteria. An improved clamping surface including resilient pads made of the family of resilient friction materials identified below provides positive gripping action for lightweight and heavyweight garments alike. The clamping surface provides excellent gripping ability in both cold and hot environments. The resilient pads are smooth to the touch and do not mark the garments. Finally, they adhere to conventional plastic clamp-type garment hangers.

BRIEF DESCRIPTION OF THE INVENTION

The improved clamp-type garment hanger of the present invention includes a cross-bar having two ends with a hook located about the center of the cross-bar. Two clamp assemblies, one clamp assembly located at each end of the cross-bar, provide means for securing a pant or skirt to the garment hanger. Each clamp assembly includes two clamping members and a means for biasing the two clamping members into a garment clamping position.

In the preferred embodiment, each clamping member includes one resilient friction pad located on the inner clamping surface. The resilient friction pad is fabricated from a resilient friction material comprising a block copolymer having discreet block segments of styrene monomer units and rubber monomer units. The co-efficient of friction between the resilient pad and the garment is sufficiently high to preclude movement of the garment under the garment's weight when a normal clamping force is applied to the clamping members in the clamping position.

The application of block copolymers having discreet block segments of styrene monomer units and rubber monomer units is ideal for clamp-type garment hangers of all conventional designs. However, the use of a block copolymer having discreet block segments of styrene monomer and rubber monomer units is not limited to the specific clamp-type garment hanger embodiments described in the drawings.

BRIEF DESCRIPTION OF THE DRAWINGS

This invention is illustrated more or less diagrammatically in the accompanying drawing wherein.

DETAILED DESCRIPTION OF THE INVENTION

Figures 1, 2, 3, 4, 5, 6:
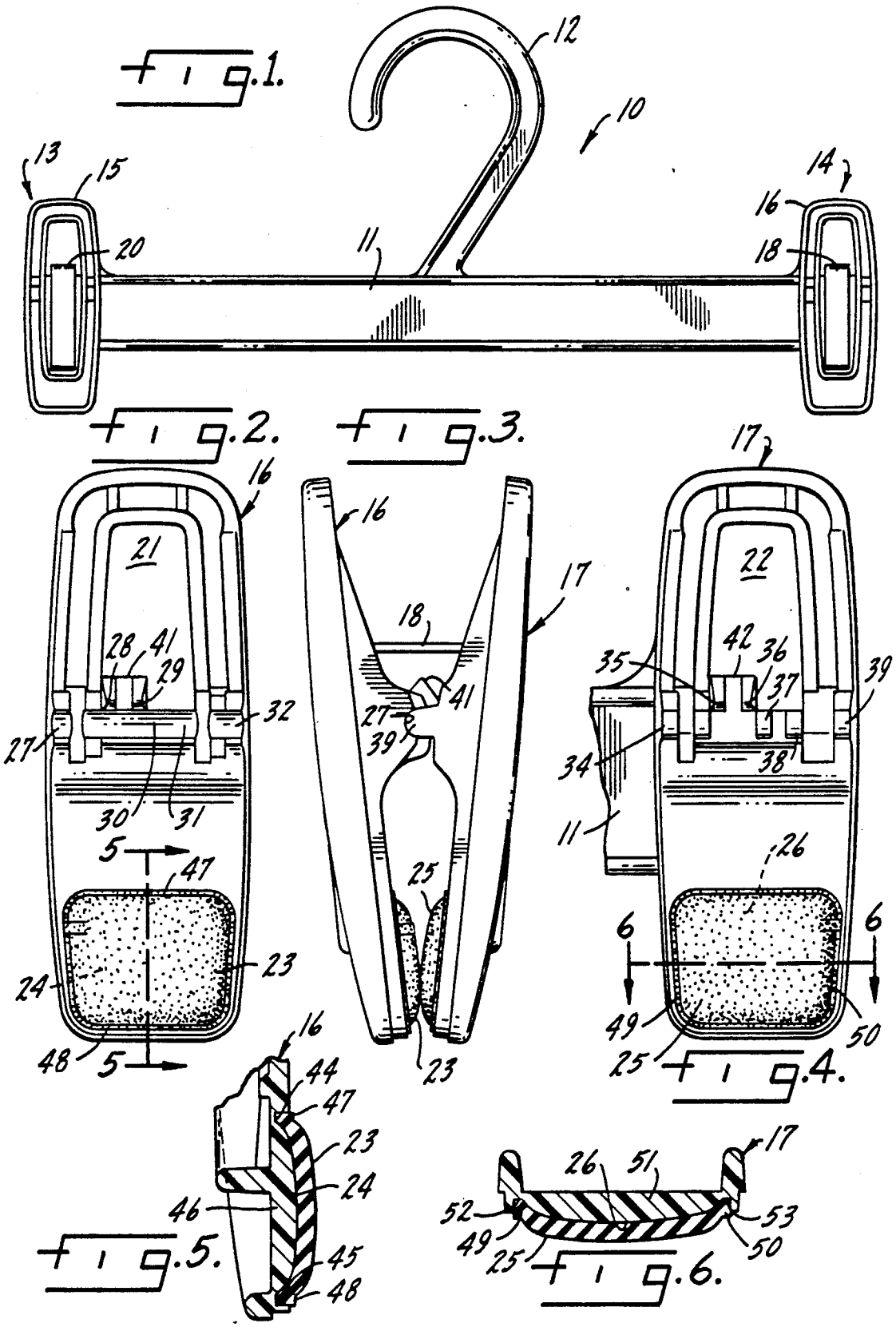
FIG. 1 is a front elevation of one embodiment of a clamp-type garment hanger made in accordance with this invention.
FIG. 2 is an enlarged view of the clamping surface of the right front clamping member of the hanger illustrated in FIG. 1.
FIG. 3 is an enlarged side view of the right clamp assembly of the garment hanger illustrated in FIG. 1.
FIG. 4 is a enlarged view of the clamping surface of the right rear clamping member of the garment hanger illustrated in FIG. 1.
FIG. 5 is a section taken substantially along line 5—5 of FIG. 2.
FIG. 6 is a section taken substantially along line 6—6 of FIG. 4.

Like reference numerals will be used to refer to like or similar parts from Figure to Figure in the following description of the drawing.

One clamp-type garment hanger embodiment of this invention is illustrated generally at 10 in FIG. 1. The hanger consists of a cross-bar and a suspending device, here a hook, indicated generally at 12.

As with conventional clamp-type garment hangers, two clamp assemblies, or clamps, 13 and 14 are located at either end of cross-bar 11. Each clamp assembly includes a front clamping member, indicated at 15 for the left clamp assembly 13 and at 16 for the right clamp assembly 14, and a rear clamping member, indicated at 17 for the right clamp assembly 14 in FIGS. 3 and 4; the rear clamping member of the left clamp assembly 13 is not shown.

The right front clamping member 16 and the right rear clamping member 17 (see FIGS. 1 and 3) are spring-biased toward the garment clamping position by a U-shaped clamp 18. The left clamp assembly 13 is spring-biased toward the garment clamping position by an identical U-shaped clamp 20.

FIGS. 2, 3 and 4 illustrate the construction of the right clamp assembly 14. While the left clamp assembly 13 is not illustrated in detail, it will be understood that the left clamp assembly 13 includes the same parts as the right clamp assembly 14.

An elongated vertically oriented aperture is indicated at 21 in the right front clamping number 16 and a similar aperture is indicated at 22 in the right rear clamping number 17 as best seen in FIGS. 2 an 4. The apertures 21 and 22 accommodate the U-shaped clamp 18 which reciprocates between an upper, disengaged position to a lower, engaged (and clamped) position as will appear in greater detail herein. A resilient pad is indicated at 23, the pad 23 being fabricated from a resilient friction material that positively engages the garment. Resilient pad 23 is carried by the inner clamping surface 24 of the right front clamping member 16.

As best illustrated in FIGS. 3 and 4, a resilient pad 25 acts in cooperation with resilient pad 23 to positively grip the garment when the right clamp assembly 14 is in the garment clamping position. The resilient pad 25 being carried on the inner clamping surface 26 of the rear clamping member 17 (see FIG. 4). The cross-bar 11, hook 12, and both rear clamping members (see 17) are molded together and integrally connected. The front clamping members 16 and 17 are molded separately and are physically attached to the rear clamping members (see FIG. 3) by the U-shaped clamps 18 and 20 and pivot mechanisms which are described hereafter FIG. 3, together with FIGS. 2 and 4, illustrates the means for attaching the front clamping member 16 to the rear clamping member 17. The front clamping member 16 and the rear clamping member 17 include six complementary pivot points each, indicated at 27, 28, 29, 30, 31, and 32 on the front clamping member 16 and at 34, 35, 36, 37, 38 and 39 on the rear clamping member 17. The upwardly protruding nubs 41 and 42, along with other complementary parts of the clamping members 16, 17 are in proper alignment when the two clamping members 16, 17 are hingedly connected by the U-shaped clamp 18. The U-shaped clamp 18, when moved to the clamping position of FIGS. 1 and 3, maintains the front clamping member 16 and the rear clamping member 17 in locking engagement and thereby biases the clamping surfaces 24 and 26 and thus the pads 23 and 25 into the garment clamping position.

FIG. 5 illustrates an efficient way to adhere the resilient pad 23 to the inner clamping surface 24 of the front clamping member 16. The inner clamping surface 24 contains two slots 44 and 45 disposed on opposite ends of the protuberance 46. A coating of resilient friction material which, upon hardening, forms the resilient pad 23, is applied to the protuberance 46, with the upper horizontal slot 44 and lower horizontal slot 45 accommodating the upper edge 47 and the lower edge 48 of the resilient pad 23.

FIG. 6 illustrates the analogous relationship with respect to the sides 49 and 50 of the resilient pad 25. The protuberance 51 for rear clamping number 17 is coated with a layer of resilient friction material which, upon hardening, results in the resilient pad 25. The vertical sides 49 and 50 of the resilient pad 25 are formed in slots 52 and 53 respectively. Generally, the resilient friction material that, upon hardening, results in the resilient friction pads 23 and 25 is applied to the inner clamping surfaces 24 and 26 when resilient friction material is in a molten state and the inner clamping surfaces are still hot after molding. This technique eliminates the need for glue or adhesives. The geometry of the adhering means shown in FIGS. 5 and 6, and particularly the slots 44, 45, 52 and 53, ensures lasting attachment of the pads 23 and 25.

Figure 7:
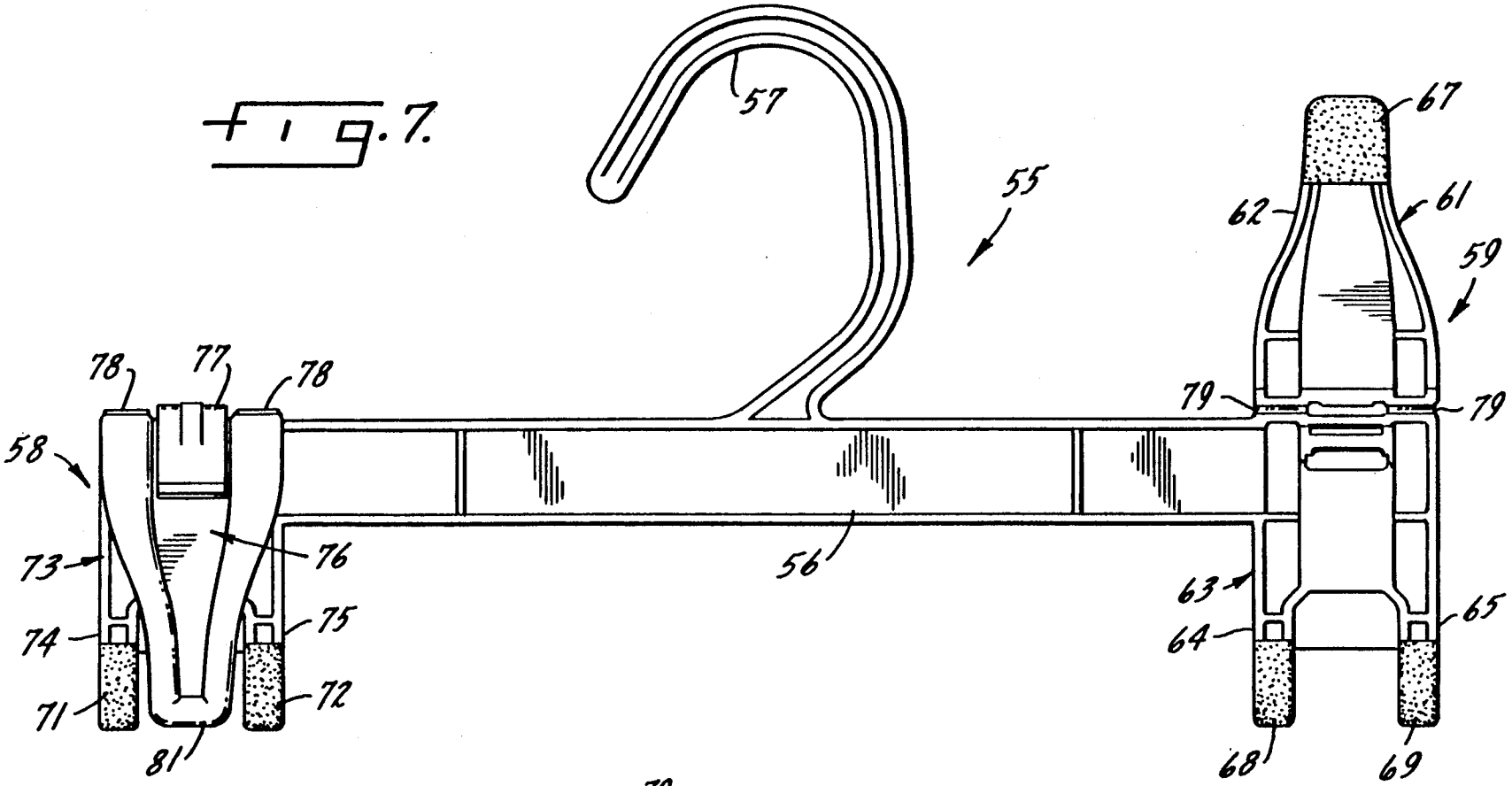
FIG. 7 is a front elevation of another embodiment of a clamp-type garment hanger made in accordance with this invention.

FIG. 7 illustrates yet another embodiment of a clamp-type garment hanger 55 made in accordance with the present invention. The garment hanger 55 also features a cross-bar 56 with a hang means, in this case a hook 57, attached at about the middle of the cross-bar 56. Two clamp assemblies 58 and 59 are located on either end of the cross-bar 56. The right clamp assembly 59 illustrates the clamping mechanism of this design in the open position. The front clamping member, indicated generally at 61, includes a single downwardly extending finger 62. The rear clamping member, indicated generally at 63, includes two downwardly extending fingers 64 and 65. The garment engaging surfaces of the right clamp assembly 59 are shown at 67, 68, and 69.

Two garment engaging surfaces 71 and 72 of the left rear clamping member 73 are shown carried by their respective downwardly extending fingers 74 and 75. The garment engaging surface of the left front clamping member 76 is not shown. The front clamping members 61 and 76 are biased toward the garment clamping position by U-shaped clamps, only one of which is shown on the left at 77.

The hinge mechanism of this design, shown generally at 78 and 79 is commonly referred to as a "living" hinge, meaning the right clamp assembly 59, which includes front clamping member 61, rear clamping member 63 and hinge 79, and left clamp assembly 58, which includes front clamping member 76, rear clamping member 73 and hinge 78 are all molded as one piece of plastic. In the case of the hangers illustrated in FIGS. 7, 8 and 9, the hooks, cross-bars and clamping members are all molded together and each hanger incorporates "living hinges" in the clamping mechanisms.

Figure 8:
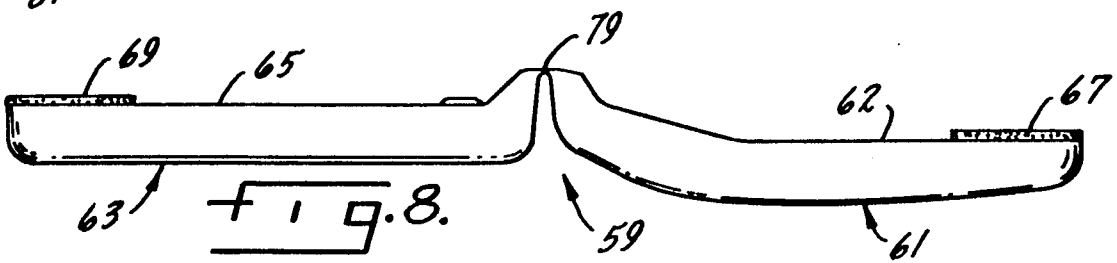
FIG. 8 is a side view of the right clamp assembly in an open position of the clamp-type garment hanger illustrated in FIG. 7.

FIG. 8 illustrates the coatings of the resilient friction material 67 and 69 as applied to the front inner clamping surface of the finger 62 and the rear inner clamping surface of the finger 65 respectively. The coating of resilient material 68 on the finger 64 is not shown in FIG. 8 but is identical. A thin coat of resilient friction material is applied to both sets of front downwardly protruding fingers 62 and 81 and both sets of rear downwardly protruding fingers 64, 65 and 74, 75. The resilient material is applied to the fingers in a molten state shortly after the hanger is molded and while the fingers are still hot, thereby eliminating the need for glue or adhesive.

Figures 9, 10, 11:
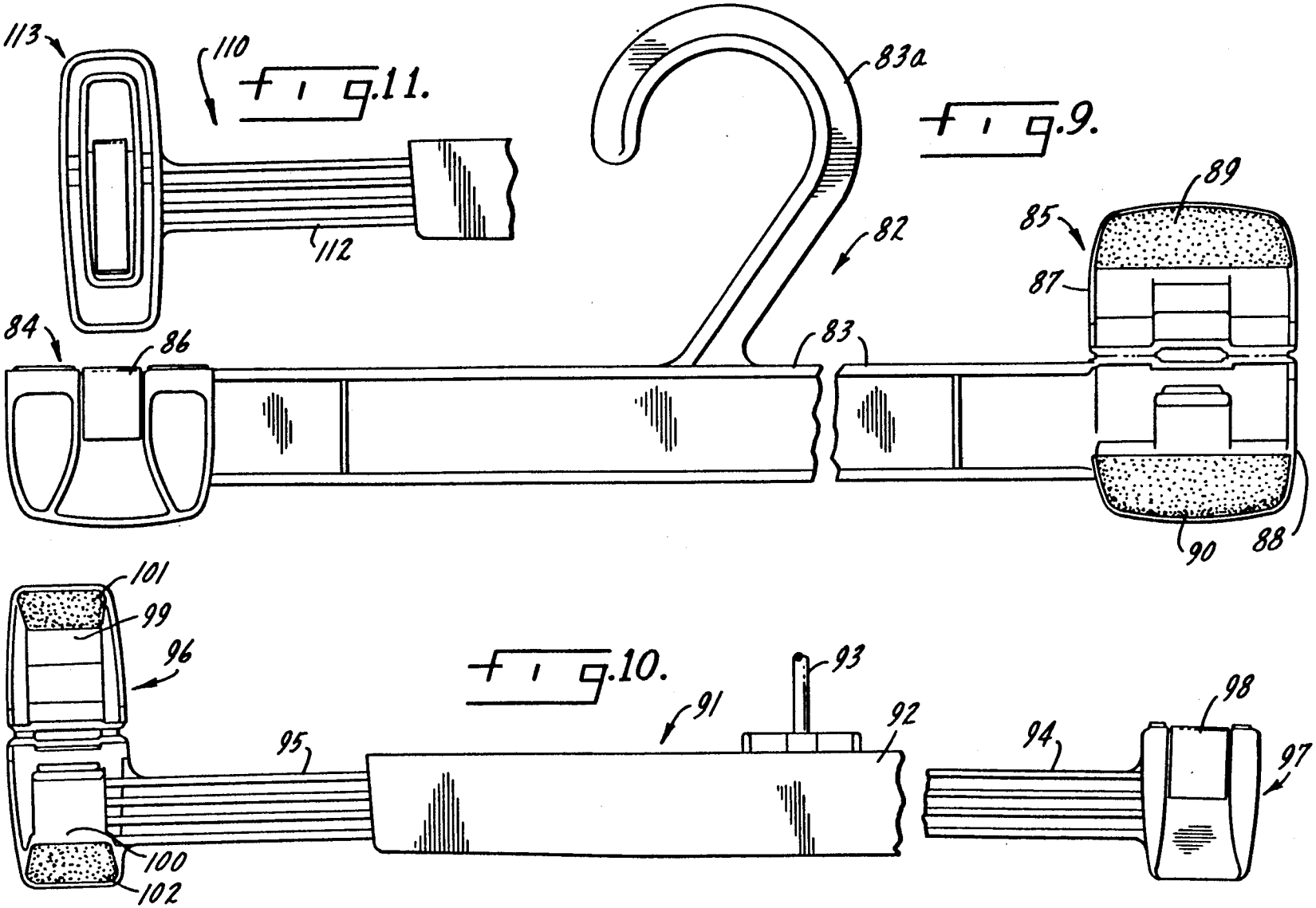
FIG. 9 is a front elevation of another embodiment of the clamp-type garment hanger made in accordance with this invention with the right clamp assembly in an open position.
FIG. 10 is a partial front elevation of an adjustable-width clamp-type garment hanger made in accordance with this invention with the left clamp assembly in an open position.
FIG. 11 is a partial front elevation of a left clamp assembly of an adjustable width clamp-type garment hanger made in accordance with this invention.

FIG. 9 illustrates yet another embodiment of a clamp-type garment hanger 82 made in accordance with the present invention. The hanger 82 also incorporates a cross-bar 83 and a hang means, such as a hook 84 attached at about the middle of the cross-bar 83. Two clamp assembly assemblies 84 and 85 are fixably attached at either end of cross-bar 83. The right clamp assembly 85 illustrates a clamp assembly in the open position The left clamp assembly 84 illustrates a clamp assembly in the closed position.

A U-shaped clamp, identical to the one shown at 86, biases the right front clamping member 87 and right rear clamping member 88 into the garment clamping position Resilient friction material is carried by the front clamping member 87 and the rear clamping member 88 in the form of resilient pads 89 and 90 respectively The molten resilient friction material used to form resilient pads 89 and 90 are applied to the inner clamping surfaces 87 and 88 when the molded plastic comprising the surfaces 87 and 88 is still hot, thereby eliminating the need for glue or adhesive. The manner in which resilient pads 89, 90 are attached to the garment clamping members 87, 88 is structurally analogous to the method shown in FIG. 8.

FIG. 10 illustrates yet another clamp-type garment hanger 91 made in accordance with the present invention that is width-adjustable. This type of hanger features a cross-bar 92 with a hang means 93 attached at about the middle of the cross-bar. Extension members 94 and 95 extend outward from the cross bar 92 and are spring biased in the outward position by springs, not illustrated, within cross-bar 92. The clamp assemblies 96 and 97 are spring biased in the garment clamping position by a U-shaped clamp indicated generally at 98.

As can be seen with clamp assembly 96 in the open position, the inner clamping surfaces, indicated at 99 and 100, are equipped with resilient friction pads 101 and 102 to positively grip a garment. The resilient pads 101 and 102 are attached to the inner clamping surfaces 99 and 100 in a manner structurally analogous to the method shown in FIGS. 5 and 6.

FIG. 11 illustrates the left clamp assembly 113 and the left extension member 112 of a width-adjustable hanger 110. The width-adjustable hanger 110 incorporates the clamping mechanism of the hanger 10 shown in FIG. 1 with the width-adjustable mechanism of the hanger 91 shown in FIG. 10.

The resilient friction materials best suited for frictionally engaging a garment placed in between two pads are block copolymers having discreet block segments of styrene monomer units and rubber monomer units. These materials have the common quality of providing a high co-efficient of friction with slippery clothing materials such as silk, rayon, polyester and linen. This family of block copolymers generally breaks down into two types: polymers which include unsaturated rubber monomer units and polymers which include saturated rubber monomer units.

Specific examples of polymers employing unsaturated rubber monomer units include a structure which is linear in nature (A-B-A type). These polymers include styrene-butadiene-styrene (S-B-S) and styrene-isoprene-styrene (S-I-S)

The other subcategory of acceptable resilient frictional materials incorporates saturated rubber monomer units. Those compounds include linear styrene-ethylene/butylene-styrene (S-EB-S). In addition to the linear (A-B-A) polymers, there are specialized polymers of the radial $(A\text{-}B)_n$ type. Those polymers include $(\text{styrene-butadiene})_n$, $(S\text{-}B)_n$, or $(\text{styrene-isoprene})_n$, $(S\text{-}I)_n$. Further, polymers of the diblock (A-B) type have been found acceptable. Those polymers include styrene-butadiene (S-B), styrene-ethylene/propylene (S-EP), and styrene-ethylene/butylene (S-EB). Each block segment of the above-mentioned polymers may be 100 monomer units or more.

The preferred resilient friction materials discussed are commercially available from the Shell Chemical Company of Woodstock, Ill. Specific grades of the preferred resilient materials that are usable are G-2706, G-7705, D-3226 and D-2109.

Although preferred embodiments of the present invention have been illustrated and described, it will at once be apparent to those skilled in the art that variations may be made within the spirit and scope of the invention. Accordingly, it is intended that the scope of the invention be limited solely by the scope of the hereafter appended claims and not by the specific words in the foregoing description.

We claim:

1. An improved clamp-type garment hanger, the hanger including hang means, a cross-bar having two ends, the hang means extending upwardly from a central area of the cross-bar for suspending the garment hanger from a support location, garment suspending means including two clamp assemblies, one clamp assembly located at each end portion of the cross-bar for securing a garment to the garment hanger, each clamp assembly including a first clamping member and a second clamping member and means for biasing the first and second clamping members toward one another and into abutting engagement with a garment located between the clamping members, each clamping member including at least one inner clamping surface, at least one inner clamping surface including at least one resilient pad, a first side of the resilient pad being carried by the inner clamping surface of one of the clamping members, a second side of the resilient pad being presented for contact with a garment to be hung from the hanger, the resilient pad being fabricated from resilient friction material, the resilient friction material comprising a block copolymer having discreet block segments of styrene monomer units and rubber monomer units, the co-efficient of friction of the second side of the resilient pad being sufficiently high to preclude movement under the weight of the garment when a normal clamping force is applied to the two clamping members to move them into a clamping position.

2. The improved clamp-type garment hanger of claim 1, wherein the block copolymer has a linear styrene-rubber-styrene structure.

3. The improved clamp-type garment hanger of claim 1, wherein the block copolymer has a radial (styrene-rubber)$_n$ structure.

4. The improved clamp-type garment hanger of claim 1, wherein the block copolymer has a diblock (styrene-rubber) structure.

5. The improved clamp-type garment hanger of claim 1, wherein the rubber monomer unit is selected from the group consisting of butadiene, isoprene, ethylene/-butylene or ethylene/propylene.

6. The improved clamp-type garment hanger of claim 1, wherein each inner clamping surface includes a plurality of resilient pads.

7. The improved clamp-type garment hanger of claim 1, wherein each clamping member includes a plurality of resilient pads.

8. An improved clamp-type garment hanger, the hanger including hang means, a cross-bar having two ends, the hang means extending upwardly from a central area of the cross-bar for suspending the garment hanger from a support location, garment suspending means including two clamp assemblies, one clamp assembly located at each end portion of the cross-bar for securing a pant or skirt to the garment hanger, each clamp assembly including a front clamping member and a rear clamping member, the rear clamping member being an integral extension of the cross-bar and being stationary with respect to the cross-bar, the front clamping member being pivotally connected to the rear clamping member by hinge means, the front and rear clamping members include an outer surface and an inner clamping surface, the outer surfaces of the front and rear clamping members include a recessed channel for accommodating a U-shaped clamp, the U-shaped clamp resiliently urging the front and rear clamping members into a garment clamping position, at least one inner clamping surface including at least one resilient pad, a first side of the resilient pad being secured to and carried by the inner clamping surface of one of the clamping members, a second side of the resilient pad being presented for contact with a garment to be hung from the hanger, the resilient pad being fabricated from resilient friction material, the resilient friction material comprising a block copolymer having discreet block segments of styrene monomer units and rubber monomer units, the co-efficient of friction of the second side of the resilient pad being sufficiently high to preclude movement under the weight of the garment when a normal clamping force is applied to the two clamping members to move them into clamping position.

9. The improved clamp-type garment hanger of claim 8, wherein the block copolymer has a linear styrene-rubber-styrene structure.

10. The improved clamp-type garment hanger of claim 8, wherein the block copolymer has a radial (styrene-rubber)$_n$ structure.

11. The improved clamp-type garment hanger of claim 8, wherein the block copolymer has a diblock (styrene-rubber) structure.

12. The improved clamp-type garment hanger of claim 8, wherein the rubber monomer unit is selected from the group consisting of butadiene, isoprene, ethylene/-butylene or ethylene/propylene.

13. The improved clamp-type garment hanger of claim 8, wherein each inner clamping surface includes resilient pads.

14. The improved clamp-type garment hanger of claim 8, wherein each clamping member includes a plurality of resilient pads.

15. An improved clamp-type garment hanger, the hanger including hang means, a cross-bar having two ends, the hang means extending upwardly from a central area of the cross-bar for suspending the garment hanger from a support location, garment suspending means including two clamp assemblies, one clamp assembly located at each end of the cross-bar for securing a pant or skirt to the garment hanger, each clamp assembly including a front clamping member and a rear clamping member, each of the front and rear clamping members including an outer surface and an inner clamping surface, each of the outer surfaces of the front and rear clamping members including a recessed channel for accommodating a U-shaped clamp, the U-shaped clamp resiliently urging the front and rear clamping members into a garment clamping position, the rear clamping member including two downwardly extending fingers and being an integral extension of the cross-bar and being stationary with respect to the cross-bar, the two downwardly extending fingers being laterally spaced from one another, the front clamping member including one downwardly extending finger, the one downwardly extending finger of the front clamping member being aligned to fall in between the two downwardly extending fingers of the rear clamping member in the garment clamping position, each downwardly extending finger including an inner clamping surface, at least one inner clamping surface including at least one resilient pad, a first side of the resilient pad being secured to and carried by the inner clamping surface of one of the downwardly extending fingers, a second side of the resilient pad being presented for contact with a garment to be hung from the hanger, the resilient pad being fabricated from resilient friction material, the resilient friction material comprising a block copolymer having discreet block segments of styrene monomer units and rubber monomer units, the co-efficient of friction of the second side of the resilient pad being sufficiently high to preclude movement under the weight of the garment when a normal clamping force is applied to the two clamping members to move them into clamping position.

16. The improved clamp-type garment hanger of claim 15, wherein the block copolymer has a linear styrene-rubber-styrene structure.

17. The improved clamp-type garment hanger of claim 15, wherein the block copolymer has a radial $(\text{styrene-rubber})_n$ structure.

18. The improved clamp-type garment hanger of claim 15, wherein the block copolymer has a diblock (styrene-rubber) structure.

19. The improved clamp-type garment hanger of claim 15, wherein the rubber monomer unit is selected from the group consisting of butadiene, isoprene, ethylene/-butylene or ethylene/propylene.

20. The improved clamp-type garment hanger of claim 15, wherein each inner clamping surface includes resilient pads.

21. The improved clamp-type garment hanger of claim 15, wherein each downwardly extending finger including a plurality of resilient pads.

22. An improved clamp-type garment hanger, the hanger including hang means a cross-bar including width adjustment means, said width adjustment means including two spring means, each spring means extending along the cross-bar in opposite directions from the middle of the cross-bar and in abutting engagement with a lateral extension member, the hang means extending upwardly from a central area of the cross-bar for suspending the garment hanger from a support location, garment suspending means including two clamp assemblies, one clamp assembly located at each distal end portion of the lateral extension member for securing a garment to the garment hanger, each clamp assembly including a first clamping member and a second clamping member and means for biasing the first and second clamping members toward one another and into abutting engagement with a garment located between the clamping members, each clamping member including at least one inner clamping surface, at least one inner clamping surface including at least one resilient pad, a first side of the resilient pad being secured to and carried by the inner clamping surface of one of the clamping members, a second side of the resilient pad being presented for contact with a garment to be hung from the hanger, the resilient pad being fabricated from resilient friction material, the resilient friction material comprising a block copolymer having discreet block segments of styrene monomer units and rubber monomer units, the co-efficient of friction of the second side of the resilient pad being sufficiently high to preclude movement under the weight of the garment when a normal clamping force is applied to the two clamping members to move them into clamping position.

23. The improved clamp-type garment hanger of claim 22, wherein the block copolymer has a linear styrene-rubber-styrene structure.

24. The improved clamp-type garment hanger of claim 22, wherein the block copolymer has a radial $(\text{styrene-rubber})_n$ structure.

25. The improved clamp-type garment hanger of claim 22, wherein the block copolymer has a diblock (styrene-rubber) structure.

26. The improved clamp-type garment hanger of claim 22, wherein the rubber monomer unit is selected from the group consisting of butadiene, isoprene, ethylene/-butylene or ethylene/propylene.

27. The improved clamp-type garment hanger of claim 22, wherein each inner clamping surface includes resilient pads.

28. The improved clamp-type garment hanger of claim 22, wherein each clamping member includes a plurality of resilient pads.

* * * * *